US007695130B2

(12) United States Patent
Nishino

(10) Patent No.: US 7,695,130 B2
(45) Date of Patent: Apr. 13, 2010

(54) INK JET RECORDING APPARATUS

(75) Inventor: Satoshi Nishino, Sayama (JP)

(73) Assignee: Konica Minolta Medical & Graphic, Inc. (JP)

( * ) Notice: Subject to any disclaimer, the term of this patent is extended or adjusted under 35 U.S.C. 154(b) by 651 days.

(21) Appl. No.: 11/583,239

(22) Filed: Oct. 19, 2006

(65) Prior Publication Data

US 2007/0097195 A1 May 3, 2007

(30) Foreign Application Priority Data

Oct. 28, 2005 (JP) ..... 2005-314307

(51) Int. Cl.
*B41J 2/01* (2006.01)

(52) U.S. Cl. ..... 347/104; 347/103; 347/102

(58) Field of Classification Search ..... 347/102, 347/104, 103, 101
See application file for complete search history.

(56) References Cited

U.S. PATENT DOCUMENTS 4,592,543 A * 6/1986 Tanimoto et al. ..... 271/227
2002/0057332 A1* 5/2002 Sasaki ..... 347/262
2003/0218652 A1* 11/2003 Nakashima ..... 347/31

FOREIGN PATENT DOCUMENTS

JP 2003-276256 9/2003
JP 2004-338264 12/2004

* cited by examiner

*Primary Examiner*—Manish S Shah
(74) *Attorney, Agent, or Firm*—Cantor Colburn LLP

(57) ABSTRACT

An ink jet recording apparatus provided with a supporting member to support and convey a recording medium in a prescribed direction, a recording head to emit ink onto the recording medium, an activation energy ray irradiation unit which irradiates an activation energy ray on the ink emitted on the recording medium, and an activation energy ray absorption section formed by coating or mixing an activation energy ray absorption material, including an inorganic material, at a portion where the activation energy ray is irradiated.

9 Claims, 4 Drawing Sheets

INK JET RECORDING APPARATUS

CROSS REFERENCE TO RELATED APPLICATION

The present application is based on Japanese Patent Application No. 2005-314307 filed with Japan Patent Office on Oct. 28, 2005, the entire content of which is hereby incorporated by reference.

BACKGROUND OF THE INVENTION

1. Field of the Invention

The present invention relates to ink jet recording apparatuses, and in particular, to ink jet recording apparatuses provided with the function of reducing the reflected light of ultraviolet rays emitted from an ultraviolet ray emitting apparatus.

2. Description of the Related Art

Conventionally, ink jet recording apparatuses have been known as recording apparatuses that can print on various types of recording media typified by ordinary copying paper. An ink jet recording apparatus is a recording apparatus that forms images on the recording medium by emitting ink, which is the color material, directly onto the recording medium from nozzles provided on the surface of the recording head that is facing the recording medium, and making the ink land on, penetrate or get fixed onto the recording medium, and has excellent features in terms of the simplicity of the process, quietness during printing, and the quality of printing and printed images.

Recently, in ink jet recording apparatuses, there are situations in which image recording is done using as the recording medium various types of materials such as plastic or metal that do not have ink absorption capacity, and in such situations, in order to fix the ink on such recording media, it is very common to use photo-hardening type ink. Usually, in an ink jet recording apparatus using such photo-hardening type ink, an ultraviolet light radiating unit would have been installed in the apparatus for hardening the ink, and at the time of recording images on the recording media, immediately after causing the ink to land on the recording medium, the ink is hardened and fixed by irradiating the ink with ultraviolet light from a light source provided in the ultraviolet light radiating unit under some constant conditions enabling hardening of the ink such as the duration of radiation and number of times of irradiation.

As an ink jet recording apparatus provided with an ultraviolet light radiating unit described above, an ink jet recording apparatus 101 has been developed such as the one shown in FIG. 4 and FIG. 5. This ink jet recording apparatus 101 is provided with an ultraviolet light radiating unit 102 and a recording head 103 that can move freely in the left-right direction in FIG. 4 and FIG. 5 (hereinafter referred to as the main scanning direction X), and the ultraviolet light radiating unit 102 moves in the main scanning direction X in combination with the movement of the recording head in the left-right direction.

However, when the ultraviolet light radiating unit 102 is placed at the home position A shown in FIG. 4 or the head movement direction changing position B shown in FIG. 5, that is, at a position at which it is not placed opposite the top surface of the platen 104, there was the problem that the reflected light of the ultraviolet light emitted from the ultraviolet light radiating unit 102 is irradiated onto the nozzle of the recording head 103, thereby causing the ink accumulated in the recording head 103 to get hardened.

In view of this, as a ink jet recording apparatus in which it is possible to prevent the clogging of the ink path of the recording head 103 due to hardening of the ink, as is shown in FIG. 6, an ink jet recording apparatus 111 has been developed (see, for example, Patent Document 1) in which plate members 105 and 106 that prevent reflection of ultraviolet light towards the recording head 103 have been placed in the regions of the home position A and the head movement direction changing position B so that they are in close contact with the bottom surface of the ultraviolet light radiating unit 102.

Further, in the case of an ink jet recording apparatus using photo-hardening type ink, because the ultraviolet light emitted from the ultraviolet light radiating unit was getting reflected at the top surface of the platen after the recording medium had passed and was irradiated on the emitting surface of the recording head, any ink or ink mist adhering to the nozzle was getting hardened. Because of this, there was the problem that the ink emitting ability was getting reduced and it was difficult to reproduce images in a stable manner.

Therefore, as an ink jet recording apparatus capable of reproducing high resolution images in a stable manner, an ink jet recording apparatus has been developed (see, for example, Patent Document 2), in which an ultraviolet light absorption section has been formed by coating an ultraviolet light absorbing material that includes an organic material (hereinafter referred to as an organic ultraviolet light absorbing material) on the top surface of the platen.

Patent Document 1: Japanese Unexamined Patent Application Open to Public Inspection No. 2004-338264.

Patent Document 2: Japanese Unexamined Patent Application Open to Public Inspection No. 2003-276256.

Here, in the case of the ink jet recording apparatus 111 disclosed in Patent Document 1 as described above, the purpose is to prevent the reflected light of the ultraviolet light emitted from the ultraviolet light radiating unit 102 placed at a position that is not opposite to the platen 104.

However, as is shown in FIG. 7, in case the ultraviolet light radiating unit 102 is placed at a position opposite to the platen 104, since the height of the gap S formed below the recording head 103 changes depending on the thickness of the recording medium P supported by the platen 104, when a rigid base material such as a plate material with a large thickness is used for the recording medium P, the height of the gap S is widely different when compared at a position above the rigid base material and at a position away from the base material.

Therefore, if the ultraviolet light radiating unit 102 is placed at a position above the surface of the platen 104 and separated from the rigid base material, there was the problem that the ink or ink mist adhered to the nozzle of the recording head 103 was likely to get hardened because of the increase in the amount of light radiated onto the recording head 103 by the radiated ultraviolet light after being reflected from the top surface of the platen 104 due to the increase in the height of the gap S.

On the other hand, in the case of the ink jet recording apparatus disclosed in Patent Document 2 as described above, although the ultraviolet light passing through the recording medium is absorbed by the ultraviolet light absorbing section provided on the platen, however, because the organic ultraviolet light absorbing material forming the ultraviolet light absorbing section gets dissociated due to irradiation with ultraviolet light, there was the problem that the ultraviolet light absorption effect in the ultraviolet light absorption section decreased substantially.

The present invention was made considering the points mentioned above, and the purpose of the present invention is to provide an ink jet recording apparatus that can prevent the hardening of the ink or ink mist adhered to the nozzle even when the thickness dimension of the recording medium is large.

SUMMARY

An ink jet recording apparatus reflecting one aspect of the present invention for solving the above problem has the feature that it is provided with a supporting member to support and convey a recording medium in a prescribed direction, a recording head to emit ink onto the recording medium, an activation energy ray irradiation unit which irradiates an activation energy ray on the ink emitted on the recording medium, and an activation energy ray absorption section formed by coating or mixing an activation energy ray absorption material, including an inorganic material, at a portion where the activation energy ray is irradiated.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENT

Figure 1:
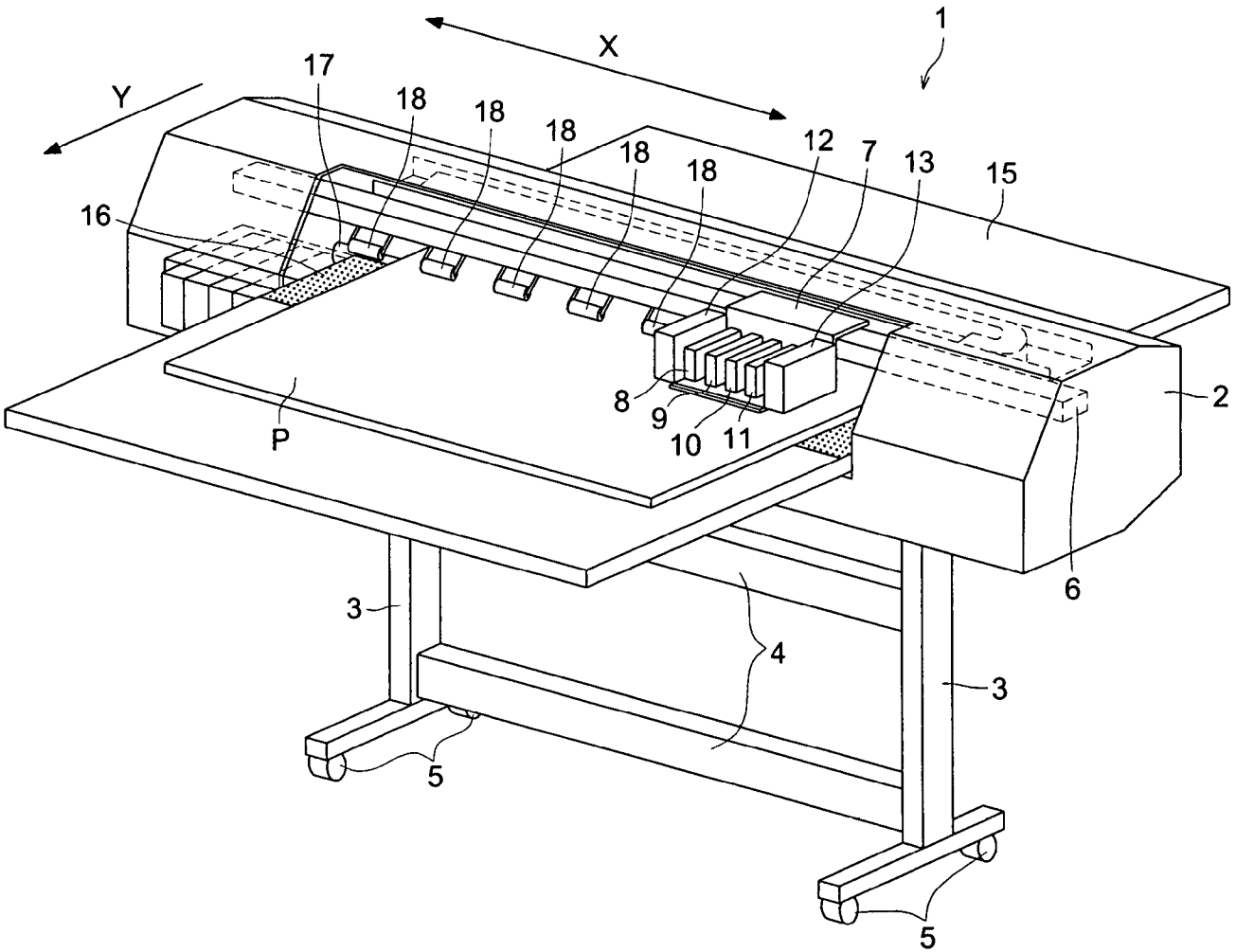
FIG. 1 is a perspective view diagram showing the configuration of an ink jet recording apparatus.

In the following, a preferred embodiment of the present invention is described with reference to the drawings. However, although in the preferred embodiment described below, several restrictions have been added that are technically desirable for implementing the present invention, the scope of the present invention shall not be limited to the following preferred embodiment or the examples shown in the drawings.

As is shown in FIG. 1, the ink jet recording apparatus 1 according to the present preferred embodiment has the respective constituent members covered by a long chassis 2. A part of the front face of the chassis 2 is made open, and on the rear face of the chassis 2, a slit-shaped conveying inlet (not shown in the figure) is provided for feeding the recording medium (not shown in the figure) to the interior of the chassis 2.

Two leg sections 3 with an inverted T shape are provided on the bottom surface of the chassis 2 described above, and the chassis 2 is supported by the two leg sections 3. Two reinforcing members 4 are provided to bridge between the two leg sections 3 so as to support strongly the chassis 2. In addition, two casters 5 have been affixed at the bottom part of each of the two leg sections 3, and the entire ink jet recording apparatus 1 is free to move in the front, back, left and right directions due to the casters 5.

On the other hand, in the interior of the chassis 2, a long guide rail has been provided that extends in the left-right direction in FIG. 1 (hereinafter, referred to as the main scanning direction X). Further, a carriage 7 with an approximately rectangular parallelepiped shape is engaged with and is supported by the guide rail 6, and this carriage 7 is free to carry out reciprocating movement in the main scanning direction X within a prescribed range while being guided by the guide rail 6.

Figure 2:
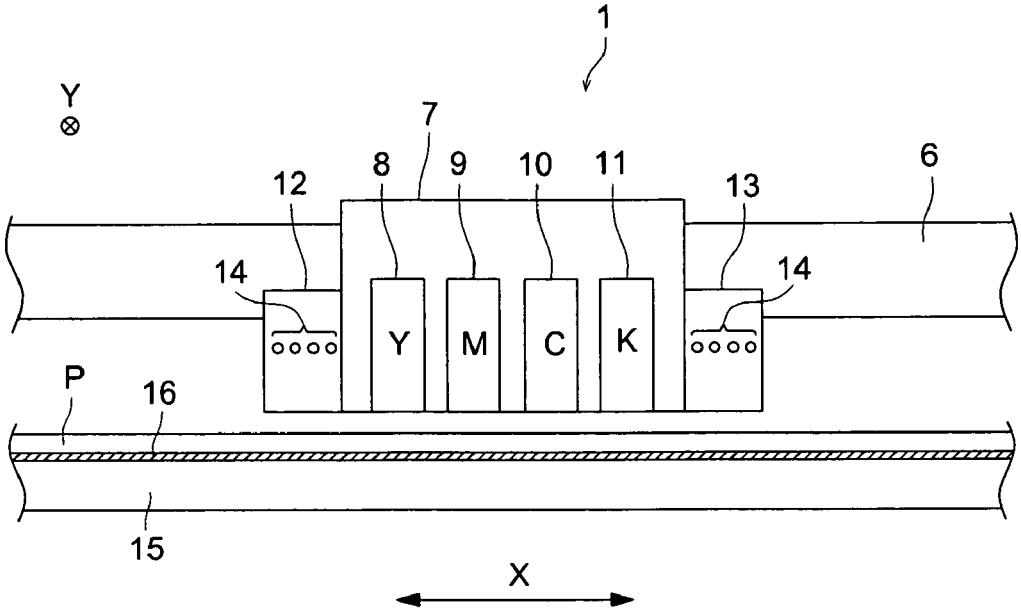
FIG. 2 is a front view diagram showing the configuration of the major part of an ink jet recording apparatus.

As is shown in FIG. 1 and FIG. 2, in the interior of the carriage 7 described above, four recording heads 8, 9, 10, and 11 are installed that emit inks of each of the process colors of yellow (Y), magenta (M), cyan (C), and black (K) towards the recording surface of the recording medium P. These recording heads 8, 9, 10, and 11 have an approximately rectangular parallelepiped shape, and ink is accumulated inside them. In addition, all the recording heads 8, 9, 10, and 11 have been arranged to be in a row along the main scanning direction X so that all their long sides are roughly parallel to each other, and move along with the reciprocating movement of the carriage 7. Further, a plurality of approximately circular shaped nozzles (not shown in the figure) that emit the ink in the form of ink droplets have been provided in a row along the longitudinal direction of each recording head 8, 9, 10, and 11 on the surfaces of each of the recording heads 8, 9, 10, and 11 facing the recording medium P (hereinafter referred to as the emitting surface).

Here, in FIG. 2, the alphabets (C, M, Y, and K) assigned to the each of the recording heads 8, 9, 10, and 11 denote the color of the ink emitted by that head.

On the other hand, at the two ends of the carriage 7 in the main scanning direction X, a total of two ultraviolet light radiating units 12 and 13 have been installed, one each at the left and right ends. These ultraviolet light radiating units 12 and 13 follow the reciprocating movement of the carriage 7, similar to the recording heads 8, 9, 10, and 11. In addition, as is shown in FIG. 2, an ultraviolet ray light source 14 that emits ultraviolet light rays is provided inside each of the ultraviolet light radiating units 12 and 13, and each of the ultraviolet light radiating units 12 and 13 emits ultraviolet light rays towards the recording surface of the recording medium P by turning on this ultraviolet ray light source 14.

Further, although not particularly restricted, a high pressure mercury lamp, a metal halide lamp, a black light, a cold cathode tube, or an LED (Light Emitting Diode), etc. can be used as the ultraviolet ray light source 14 in the present preferred embodiment.

On the lower side of the guide rail 6 and the carriage 7 described above is provided a flat platen 15 that supports the recording medium P on its non-recording surface, and an ultraviolet light absorbing section 16 formed by coating an ultraviolet light absorbing material that includes an inorganic material (hereinafter referred to as an inorganic ultraviolet light absorbing material) is provided on the top surface of this platen 15.

Figure 3:
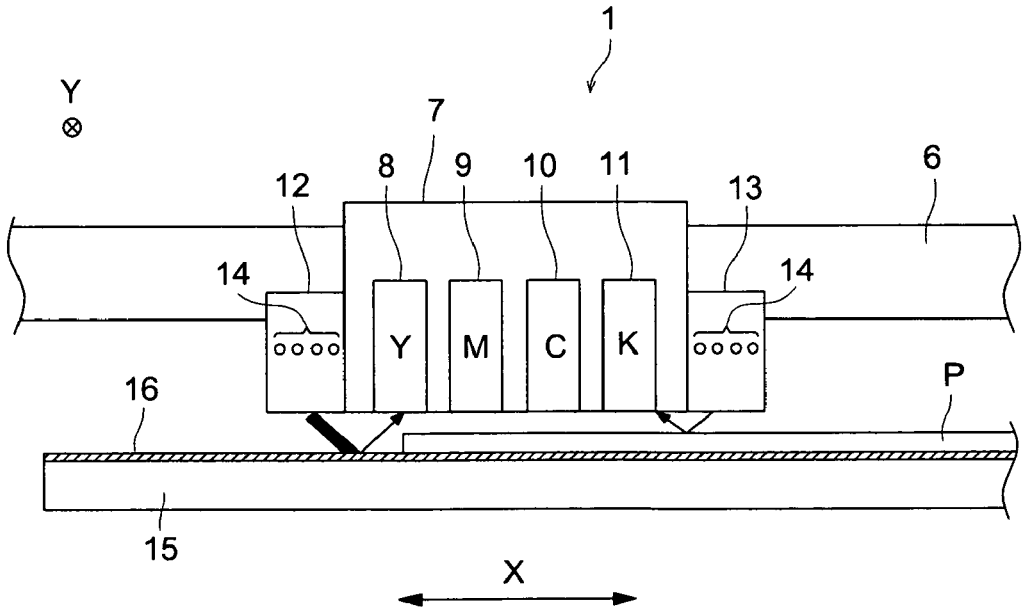
FIG. 3 is a front view showing the operation of the major part during image recording operation.
Figure 4:
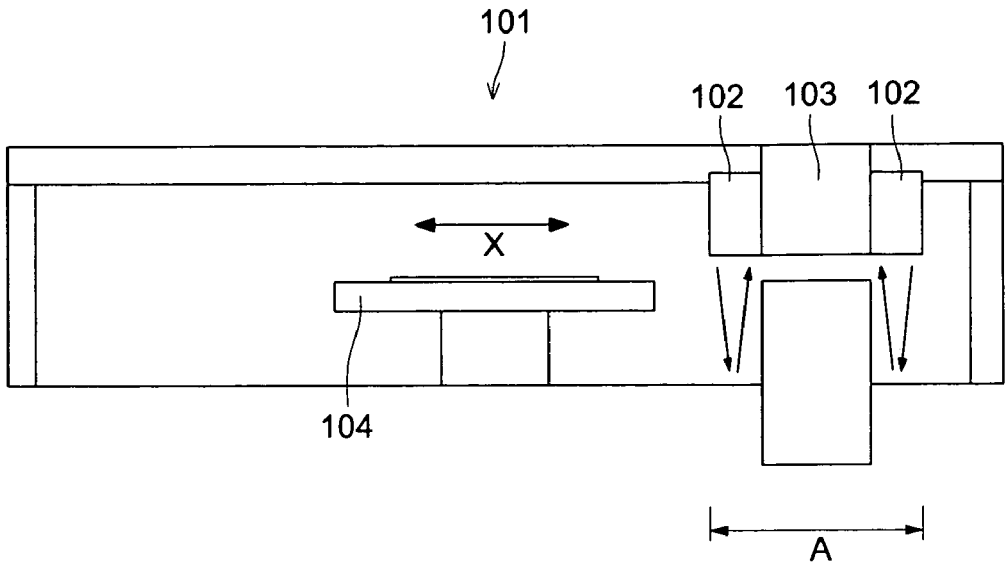
FIG. 4 PRIOR ART
FIG. 4 is a front view showing the internal configuration of an ink jet recording apparatus according to conventional technology.
Figure 5:
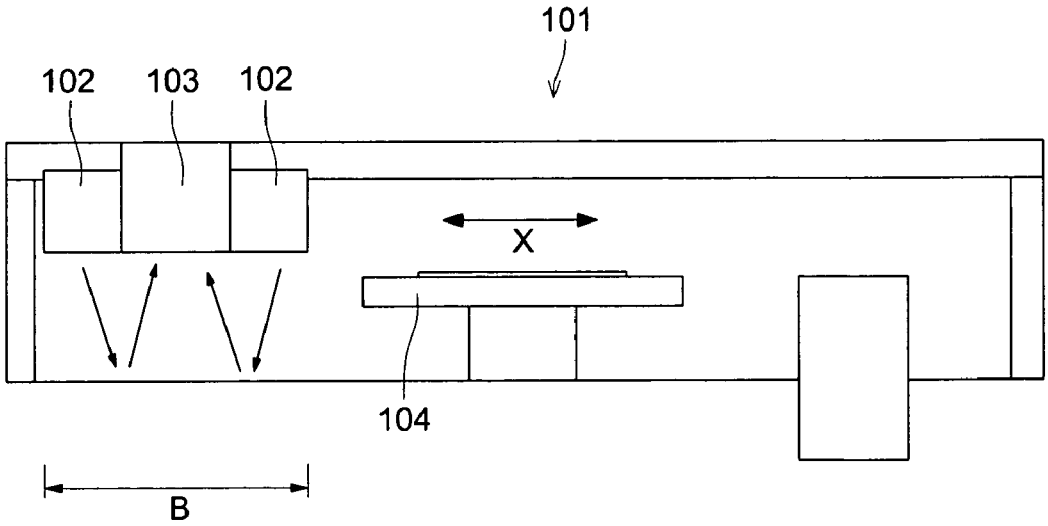
FIG. 5 PRIOR ART
FIG. 5 is a front view showing the internal configuration of another ink jet recording apparatus according to conventional technology.
Figure 6:
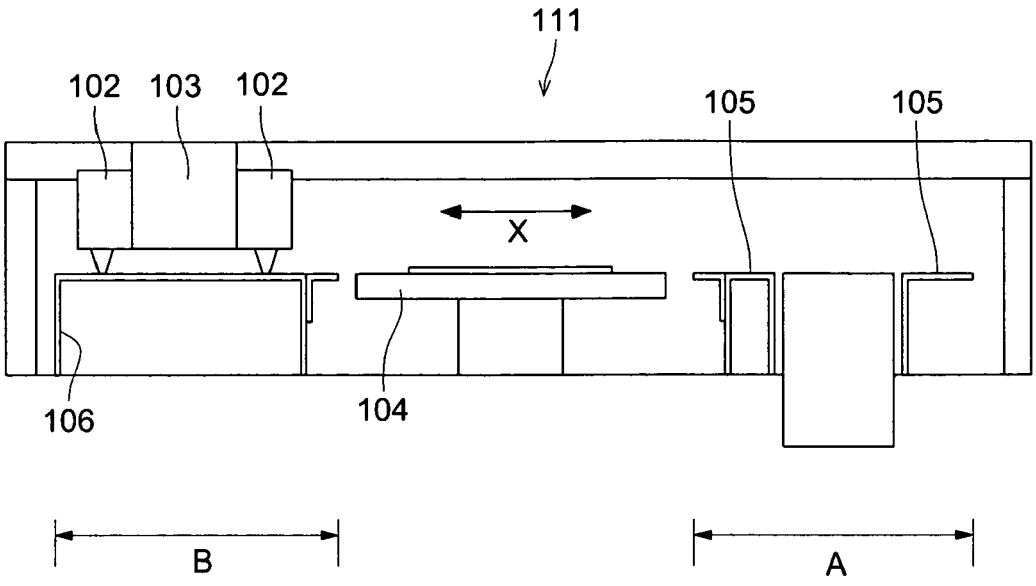
FIG. 6 PRIOR ART
FIG. 6 is a front view showing the internal configuration of yet another ink jet recording apparatus according to conventional technology.
Figure 7:
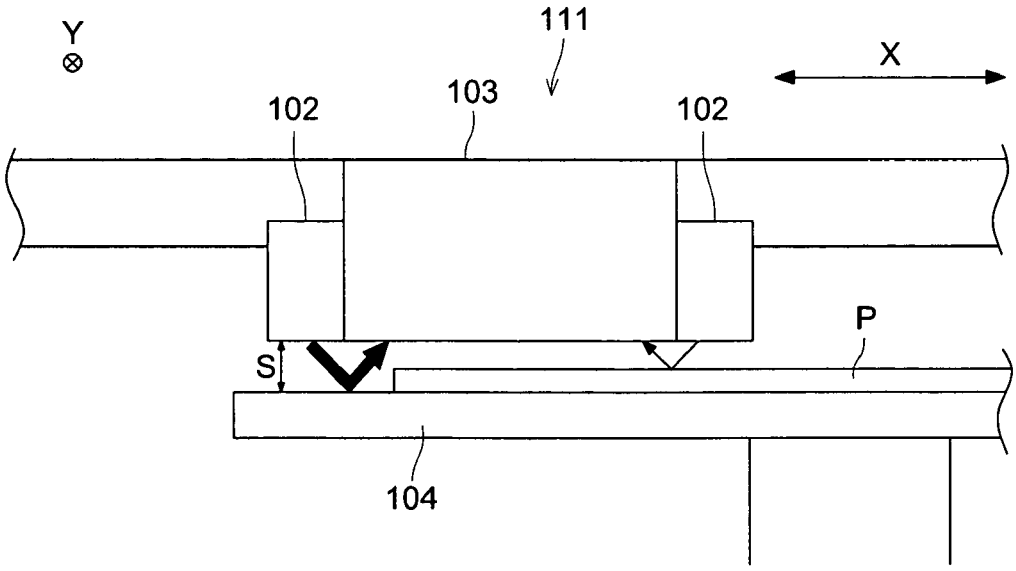
FIG. 7 PRIOR ART
FIG. 7 is a front view showing the configuration of the major part of an ink jet recording apparatus according to conventional technology.

The platen 15 configured in this manner, as is shown in FIG. 3, when a rigid base material with a large thickness dimension is used as the recording medium P, aims to reduce the reflected light towards the recording heads 8, 9, 10, and 11 by absorbing, in the ultraviolet light absorbing section 16 coated on the top surface of the platen 15, the ultraviolet light irradiated onto the top surface of the platen 15 in association with the movement along the main scanning direction X.

Further, although the ultraviolet light absorbing section 16 in the present preferred embodiment has been formed by directly coating an inorganic ultraviolet light absorbing material on the top surface of the platen 15, it is desirable for this by coating after treating the platen 15 with black alumite. The reason for this is that due to this it is possible to aim to improve the efficiency of absorption of ultraviolet light in the ultraviolet light absorbing section 16.

In addition, although the platen 15 in the present preferred embodiment has been formed using publicly known plastics or metals, when forming this using aluminum, after the ultraviolet light absorbing section 16 is formed by coating an inorganic ultraviolet light absorbing material described above, it is desirable to carry out sintering treatment. Because of this, it is possible to aim at improving the durability of the ultraviolet light absorbing section 16.

Further, while it is possible to coat the inorganic ultraviolet light absorbing material in the present preferred embodiment in the condition after mixing in the coating material, it is desirable to coat in the condition after mixing in fluorocarbon resin coating material from the point of view of maintaining the lubricating property to the recording medium P after coating.

In addition, it is desirable that the inorganic material included in the inorganic ultraviolet light absorbing material is cerium oxide or titanium oxide, and in particular, it is desirable that this is cerium oxide. Because of this, it is possible to improve absorption efficiency in the ultraviolet light absorbing section 16.

In the neighborhood of the platen 15, as is shown in FIG. 1, a conveying roller extended along the main scanning direction X has been provided, and is connected to a conveying motor not shown in the figure. In addition, a plurality of pressure rollers 18 has been provided at equal intervals above the conveying roller 17 while being separated from each other, and the recording medium conveying mechanism is configured using this conveying motor, conveying roller 17, and pressure rollers 18.

In such a recording medium conveying mechanism, the recording medium P passes through the interior of the chassis 2 from the rear face side towards the front face side while being pressed by the pressure rollers 18 because the conveying roller 17 is rotated due to the drive of the conveying motor, and finally it is discharged to outside the chassis 2.

Here, the direction of conveying the recording medium P is taken as the auxiliary scanning direction Y.

However, although the conveying roller 17 in the present preferred embodiment has been formed using a well known plastic material, it is desirable that it is formed by mixing the above mentioned inorganic ultraviolet light absorbing material and the plastic material because it is likely to be exposed to ultraviolet light and from the point of view of preventing degradation due to exposure to ultraviolet light.

The ink used in the present preferred embodiment is photo-hardening type ink that has the nature of getting hardened upon exposure to ultraviolet light, and includes as its main constituents at least a polymerizing compound (including widely known polymerizing compounds) and a photo initiator.

However, when using inks suitable for photo induced alternating copolymerization, it is possible to exclude the above photo initiator.

The photo-hardening type ink described above is broadly classified into radical polymerization type ink that includes a radical polymerizing compound as the polymerizing compound, and cationic polymerization type ink that includes cationic polymerizing compounds, and both these types of inks are suitable for use as inks in the present preferred embodiment, and it is also possible to use as the ink in the present preferred embodiment a hybrid type of ink which is a mixture of a radical polymerization type ink and a cationic polymerization type ink. However, since the cationic polymerization types of inks having small or no obstruction to the polymerization reaction by oxygen are superior in terms of functionality and versatility, in particular, it is desirable to use cationic polymerization type inks.

Further, although the recording medium P used in the present preferred embodiment is a rigid base material having a large thickness dimension, it is also possible to apply to ordinary papers used in ink jet printers, various types of paper such as recycled paper, glossy paper, etc., various types of fabrics, various types of non-woven cloth, and to recording material made of plastic material. Further, the form of the recording medium P can be a roll, a cut sheet, or a plate.

Further, although the recording medium P in the present preferred embodiment was a right base material, it is also possible to apply it to home material, steel plates, cork boards, corrugated cardboard plates, boards for electrical decorations, Polycarbo (registered trademark), glass plates etc.

Further, although the ink jet recording apparatus 1 according to the present preferred embodiment is an ink jet recording apparatus adopting the serial method in which the carriage 7 is mounted the recording heads 8, 9, 10, and 11 moves in the main scanning direction X, the ink jet recording apparatus can also be one adopting other recording methods, for example, it can be an ink jet recording apparatus adopting the line head method in which the recording head and the ultraviolet light radiating unit are arranged in the auxiliary scanning direction Y.

Next, the operation of the ink jet recording apparatus 1 according to the present preferred embodiment is described in the following.

When a prescribed image information is sent to the ink jet recording apparatus 1, the recording medium conveying mechanism carries out starting and stopping repetitively, and the recording medium P, in the condition in which its non-recording surface is being supported by the platen 15, is conveyed intermittently on the top surface of the platen 15 in the auxiliary scanning direction Y.

Next, when the carriage 7 operates every time the recording medium conveying mechanism stops, and carries out reciprocating movement in the main scanning direction X directly above the recording medium P, even the recording heads 8, 9, 10, and 11 mounted on the carriage 7 carry out reciprocating movement directly above the recording medium P in association with the movement of the carriage, and inks of prescribed colors are emitted from the nozzles of the recording heads 8, 9, 10, and 11 towards the recording medium P.

Thereafter, similar operations are repeated, the desired image is formed on the recording surface of the recording medium P, and the sequence of image recording operations is completed.

At this time, in the parts irradiated with activation rays, since the ultraviolet light absorbing section 16 is provided as the activation energy ray absorption section formed by coating or mixing an activation energy ray absorption material having an inorganic material, even when the thickness dimension of the recording medium P becomes large, by absorbing the activation energy rays in the ultraviolet light absorbing section, it is possible to suppress the reflected light from irradiating the nozzle surfaces of the recording heads 8, 9, 10, and 11.

Herein, since the ultraviolet light absorbing section 16 is provided on the surface portion of the platen 15, where the recording medium does not cover the surface and the activation energy rays are directly irradiated, the ultraviolet light absorbing section 16 effectively absorbs the rays, which are reflected and irradiated on the nozzle surfaces if they are not absorbed by the absorbing section 16.

Further, since an activation energy ray absorption material having an inorganic material is used as the activation energy ray absorption material, compared to an activation energy absorption material having an organic material, since there is no occurrence of dissociation reaction caused by irradiation with activation energy rays, it is possible to suppress almost permanently the reduction in the activation energy ray absorption effect in the ultraviolet light absorbing section 16.

In addition, since the ultraviolet light absorbing section 16 has been provided in the platen 15 or in the conveying roller 17, at the time of image recording, by providing the ultraviolet light absorbing section 16 in the platen 15 or the conveying roller 17 which is likely to be irradiated with activation energy rays away from the recording medium P, the reflected light of the activation energy rays away from the recording medium P can be efficiently suppressed from irradiating the nozzle surfaces of the recording heads 8, 9, 10, and 11.

Further, since the activation energy rays are ultraviolet light rays, by irradiating with ultraviolet rays with high energy intensity, it is possible to harden and fix efficiently the ink emitted onto the recording medium P.

In addition, since an ultraviolet light absorbing material that absorbs ultraviolet rays is being used as the activation energy ray absorbing material, even when ultraviolet rays with high energy intensity are irradiated onto the activation energy ray absorbing section, it is possible to absorb efficiently the incident ultraviolet rays.

Furthermore, since the inorganic material included in the inorganic ultraviolet light absorbing material is cerium oxide or titanium oxide, it is possible to absorb efficiently the ultraviolet rays irradiated onto the ultraviolet light absorbing section 16.

In addition, since an inorganic ultraviolet light absorbing material has been coated on the platen 15 in the condition in which it has been mixed with a fluorocarbon resin coating material, it is possible to maintain the lubricating property to the recording medium P on the platen 15.

Further, since the ink is a photo-hardening type of ink having a cationic polymerizing compound, even when the intensity of the ultraviolet light as the activation energy rays is relatively small, it is possible to harden the ink sufficiently.

Next, an example of implementing the ink jet recording apparatus according to the present preferred embodiment is described here.

Implementation Example

Using a platen provided on its surface with an ultraviolet light absorbing section made of an ultraviolet ray absorbing material having cerium oxide ("Needlal" manufactured by Taki Chemical Co., Ltd.), assuming a thickness dimension of 6 to 7 mm of the conveyed recording medium, image recording operation was carried out after adjusting so that the dimension of the gap formed between the top surface of the platen and the bottom surface of the ultraviolet light radiating unit is 8 mm.

Comparative Example

Image recording operation was carried out after adjusting so that the conditions become the same as in the above implementation example 1, excepting that the platen in the above implementation example was changed to a platen that is not provided with the ultraviolet light absorbing section.

Next, the method of evaluating the ink jet recording apparatus is explained here.

The value of equivalent light amount is taken as the evaluation item, and the measurement method is described in detail below.

A UV label (type S manufactured by Nichiyu Giken Kogyou Co., Ltd) was affixed to the nozzle surface of the recording head 5 that emits ink of yellow color, and value of equivalent light amount (mJ/cm$^2$) was obtained based on the discoloration of the UV label caused by the reflected light from the platen 15 and the results obtained are shown in Table 1 below.

Here, in the case of the platen provided with an ultraviolet light absorbing section, since differences were observed in the degree of discoloration of the UV label according to whether the distance from the ultraviolet light radiating unit is large or small, the semicircular part in the circular UV label with a diameter of 18 mm affixed on the nozzle surface which being close to the ultraviolet light radiating unit is taken as the "light source side", and the other semicircular part in the UV label away from the ultraviolet light radiating unit is taken as the "opposite to light source side", and the respective values of equivalent light amount were calculated.

Further, the values of equivalent light amount in the implementation example divided by the light quantity conversion value in the comparative example is taken as the "ratio" and is shown in the following Table 1.

TABLE 1

| | value of equivalent light amount (mJ/cm$^2$) | Ratio |
|---|---|---|
| Comparrative example | 44 | — |
| Implementation example (light source side) | 12 | Approx. 1/4 |
| Implementation example (opposite to light source side) | 6.3 | Approx. 1/7 |

Comparing the comparative example and the implementation example based on these results, it is found that the value of equivalent light amount was far lower in the implementation example compared to the comparison example, irrespective of the light source side or the opposite to light source side. In other words, it was confirmed that the quantity of light of the reflected light of the ultraviolet light irradiated onto the recording head had been reduced substantially.

Further, since the light quantity conversion value tolerated by the recording head varies depending on the type of ink used and the change or modification in the sensitivity, it is to be noted that the reduction to the value of equivalent light amount of the implementation example described above is not necessarily desirable.

From the above, according to the ink jet recording apparatus 1 of the present preferred embodiment, since an ultraviolet light absorbing section 16 is provided as the activation energy ray absorption section formed by coating or mixing an activation energy ray absorption material including an inorganic material, even if the thickness dimension of the recording medium P becomes large, by absorbing the activation energy rays in the ultraviolet light absorbing section 16, it is possible to suppress the light irradiated onto the nozzle surfaces of the recording heads 8, 9, 10, and 11.

Therefore, it is possible to prevent the hardening of the ink or ink mist adhered to the nozzles.

In addition, since an activation energy ray absorption material having an inorganic material is used as the activation energy ray absorption material, compared to an activation energy absorption material having an organic material, since there is no occurrence of dissociation reaction caused by irradiation with activation energy rays, it is possible to suppress almost permanently the reduction in the activation energy ray absorption effect in the ultraviolet light absorbing section 16.

As a consequence, the durability of the ultraviolet light absorbing section 16 gets improved very drastically, and it is possible to eliminate the work load on the operators for carrying out part replacement or periodic maintenance operations.

In addition, since the ultraviolet light absorbing section 16 has been provided in the platen 15 or in the conveying roller 17, at the time of image recording, by providing the ultraviolet light absorbing section 16 in the platen 15 or the conveying roller 17 which is likely to be irradiated with activation energy rays away from the recording medium P, the reflected light of the activation energy rays away from the recording medium P can be efficiently suppressed from irradiating the nozzle surfaces of the recording heads 8, 9, 10, and 11.

Because of this, it is possible to prevent effectively the hardening of ink or ink mist adhered to the nozzles.

Further, since the activation energy rays are ultraviolet rays, by irradiating with ultraviolet rays with high energy intensity, it is possible to harden and fix efficiently the ink emitted onto the recording medium P.

Because of this, it is possible to carry out image recording with a high quality even on recording media that do not have ink absorption characteristics.

In addition, since an ultraviolet light absorbing material that absorbs ultraviolet rays is being used as the activation energy ray absorbing material, even when ultraviolet rays with high activation energy intensity are irradiated onto the activation energy ray absorbing section 16, it is possible to absorb efficiently the incident ultraviolet rays.

Because of this, even when ultraviolet rays are irradiated, it is possible to prevent effectively the hardening of the ink or ink mist adhered to the nozzles.

Furthermore, since the inorganic material included in the inorganic ultraviolet light absorbing material is cerium oxide or titanium oxide, it is possible to absorb efficiently the ultraviolet rays irradiated onto the ultraviolet light absorbing section 16.

Because of this, it is possible to prevent effectively the hardening of the ink or ink mist adhered to the nozzles.

In addition, since an inorganic ultraviolet light absorbing material has been coated on the platen 15 in the condition in which it has been mixed with a fluorocarbon resin coating material, it is possible to maintain the lubricating property to the recording medium P on the platen 15.

Because of this, it is possible to prevent the recording material P from getting jammed on the platen 15, and hence it becomes possible to reproduce images in a stable manner.

Further, since the ink is a photo-hardening type of ink having a cationic polymerizing compound, even when the intensity of the ultraviolet light as the activation energy rays is relatively small, it is possible to harden the ink sufficiently.

Because of this, it is possible to suppress the reduction in the quality of printing or the printed image quality.

What is claimed is:

1. An ink jet recording apparatus comprising:

a supporting member to support a recording medium;

a recording head to emit ink onto the recording medium;

an activation energy ray irradiation unit which irradiates an activation energy ray on the ink emitted on the recording medium; and a conveying roller, arranged adjacent to the supporting member, to convey the recording medium in a prescribed conveying direction on the supporting member, the conveying member being extended along the direction perpendicular to the conveying direction;

wherein an activation energy ray absorption section is formed by coating or mixing an activation energy ray absorption material, including an inorganic material, on the conveying roller where the activation energy ray is irradiated.

2. The ink jet recording apparatus of claim 1, wherein the activation energy ray absorption section is provided on the supporting member.

3. The ink jet recording apparatus of claim 2, wherein the activation energy ray absorption section is provided on the supporting member at a portion where the recording medium does not cover the surface and the activation energy ray is directly irradiated.

4. The ink jet recording apparatus of claim 1, wherein the activation energy ray is an ultraviolet ray.

5. The ink jet recording apparatus of claim 1, wherein the activation energy ray absorption material is an ultraviolet ray absorbing material, which absorbs ultraviolet rays.

6. The ink jet recording apparatus of claim 1, wherein the inorganic material comprises at least one of cerium oxide and titanium oxide.

7. The ink jet recording apparatus of claim 2, wherein the activation energy ray absorption section comprises a coated layer on the supporting material, the layer comprising the activation energy ray absorption material mixed in a fluorocarbon resin coating material.

8. The ink jet recording apparatus of claim 1, wherein the ink is a photo-hardening type ink comprising a cationic polymerizing compound.

9. The ink jet recording apparatus of claim 1, wherein the conveying roller is formed with a plastic material and the activation energy ray absorption section is formed by mixing the activation energy ray absorption material into the plastic material.

* * * * *